United States Patent [19]

Güttinger

[11] Patent Number: 5,024,114

[45] Date of Patent: Jun. 18, 1991

[54] WOBBLE DRIVE FOR A TRANSLATIONALLY MOVING STRUCTURAL PART

[75] Inventor: Kurt Güttinger, Murten, Switzerland

[73] Assignee: Gutag Innovations AG, Murten, Switzerland

[21] Appl. No.: 409,325

[22] Filed: Sep. 19, 1989

[30] Foreign Application Priority Data

Sep. 20, 1988 [CH] Switzerland ..... 03492/88-2

[51] Int. Cl.[5] ..... F16H 23/08; F04C 3/00

[52] U.S. Cl. ..... 74/86; 74/60

[58] Field of Search ..... 74/86, 47, 48, 60, 18.1; 418/52, 53, 55 R, 51, 49, 59

[56] References Cited

U.S. PATENT DOCUMENTS

| | | | |
|---|---|---|---|
| 457,927 | 8/1891 | Smith | 418/52 |
| 1,471,820 | 10/1923 | Beam | 74/40 |
| 2,324,168 | 7/1943 | Montelius | 418/55.2 X |
| 2,825,241 | 3/1958 | Ferris | 74/60 |
| 2,841,089 | 7/1958 | Jones | 418/55.3 X |
| 3,000,263 | 9/1961 | Milton et al. | 74/48 |
| 3,125,032 | 3/1964 | Smith | 418/59 |
| 3,463,091 | 8/1969 | Delsuc | 418/59 |
| 3,560,119 | 2/1971 | Busch et al. | 418/55 |
| 3,817,664 | 6/1974 | Bennett et al. | 418/55 R |
| 3,989,422 | 11/1976 | Güttinger | 418/55 |
| 4,121,438 | 10/1978 | McCullough | 64/31 |
| 4,325,683 | 4/1982 | Miyazawa | 418/55 |
| 4,437,820 | 3/1984 | Terauchi et al. | 418/55 |
| 4,606,711 | 8/1986 | Mitsui et al. | 418/59 |
| 4,789,315 | 12/1988 | Guettinger | 418/56 |

FOREIGN PATENT DOCUMENTS 177654 8/1905 Fed. Rep. of Germany .

*Primary Examiner*—Allan D. Herrmann
*Assistant Examiner*—Winnie Yip
*Attorney, Agent, or Firm*—Burns, Doane, Swecker & Mathis

[57] ABSTRACT

A wobble drive mechanism for a translationally moving structural part includes a wobble rod which is moved by way of a crank drive mechanism. The wobble rod includes a spherical section at one end thereof that is seated in a bearing bush of a crank. At its opposite end, the wobble rod includes a second spherical section that is seated in a stationary structural part. A third spherical section is positioned between the two ends of the wobble rod and is seated in the translationally moving structural part. The spherical sections are supported in hemispherical articulation sockets located in the manner of a mirror image in the two structural parts. A spring device can be provided to ensure full contact of the spherical sections in their respective articulation sockets.

4 Claims, 1 Drawing Sheet

WOBBLE DRIVE FOR A TRANSLATIONALLY MOVING STRUCTURAL PART

BACKGROUND OF THE INVENTION

1. Field of the Invention

The invention relates to a wobble drive for a structural part moving in translation and being maintained relative to a stationary structural part in a predetermined angular relationship, said drive consisting essentially of a wobble rod:

moved by means of a crank drive mechanism and seated for the purpose at its end on the crank side with a first spherical section in a bearing bush of the crank, supported at its other end with a second spherical section in a bearing bush of the stationary structural part, coaxially relative to the crank mechanism, and comprising a third spherical section between its two ends, supported rotatingly and pivotingly in a bearing bush in the hub of the translationally moving structural part.

Wobble drive mechanisms of this type are especially suitable for devices, such as rotating piston positive displacement machines.

2. Discussion of Related Art

Wobble drives of the aforementioned type are known, for example from DE 2 603 462 and U.S. Pat. No. 3,560,119. All of those disclosed installations are displacement machines for compressible media. They each comprise a working chamber defined by helical circumferential walls extending vertically from a side wall and leading from an inlet located outside the helices to an outlet inside the helices. They further contain a helical displacement body extending into the working chamber. The latter is supported rotatingly without rotation relative to the working chamber. Its center is eccentrically offset relative to the center of the circumferential walls, so that the displacement body is always in contact with both the outer and the inner circumferential walls of the working chamber along at least one advancing line.

During the operation of the machine therefore a plurality of sickle shaped working spaces are enclosed. The working spaces move from the inlet to the outlet through the working chamber. Depending on the angle of contact of the helix, the volume of the working medium conveyed may be gradually reduced with a corresponding increase of the pressure of said medium.

In those known machines, a tumble drive is always the means to convert the rotating motion of the driving machine into the translatory motion of the displacer. Its radial offset is limited by the contact of the helical ribs with the walls of the working chambers. This limitation theoretically corresponds to a circle, in this case a translational circle.

The drive solution in DE 2,603,462 consists of an eccentric body mounted with a counter weight on the drive shaft, upon which a drive disk is located by means of a ball bearing. The latter is equipped with four ball jointed sockets in which the ball end of a wobble rod is located. The balls there are only in line contact with their sockets. During a rotating motion of the drive shaft, the rotor body is placed into a circling but not rotating motion by the wobble rods. In addition to the driving function, in this solution the wobble rods also secure the body against rotation.

In the configuration according to U.S. Pat. No. 3,560,119, the pivot of the wobble rod on the drive side is supported rotatingly and pivotingly in an eccentric position by means of a pendulum ball bearing. To prevent the rotation of the displacer itself, the second and third ball sections are provided with sectional crowns, for example, teeth, which engage the correspondingly profiled counter pieces in the displacer and the stationary housing part and are pivotingly supported in them. The wobble shaft is axially secured by means of a retaining disk fitting into the stationary housing part.

In the known machines, the relative rotating motion is always transmitted by a highly stressed and thus expensive ball bearing. Furthermore, no measure is provided to insure the operation without clearance of the machine in case of the wear of the material of the wobble rod or rods.

SUMMARY OF THE INVENTION

It is an object of the invention to develop a wobble drive mechanism of the aforementioned type so that the cooperation without clearance of the two structural parts will be possible even in the case of progressive loss of material due to wear.

According to the invention, this object may be attained because bearing bushes for the second and third spherical sections are hemispherical articulation sockets, located in the manner of a mirror image in the two structural parts, with spring means provided to insure the full contact of the spherical sections in the articulation sockets.

An advantage of the invention is to be found in that with the novel configuration a drive that is self-adjusting and nearly free of maintenance is created for the orbiting structural part.

DETAILED DESCRIPTION OF THE PREFERRED EMBODIMENTS

Figure 1:
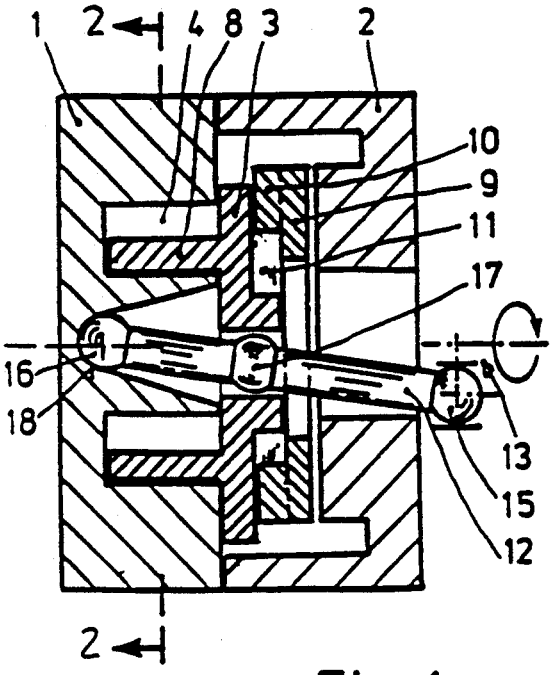
FIG. 1 is a longitudinal cross section through a pump with a revolving piston.
Figure 2:
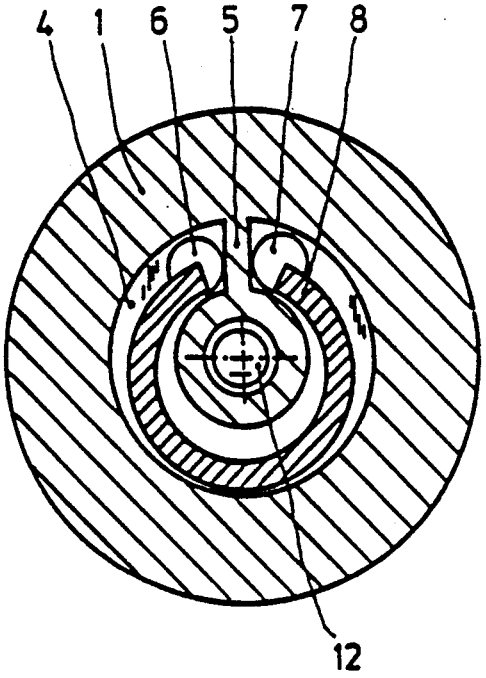
FIG. 2 is a cross section through the pump on the line 2—2 in FIG. 1.

In a simplified view of a pump according to FIGS. 1 and 2, only the parts essential for a comprehension of the invention are shown. In the different figures identical parts are designated by the same reference symbols.

It should be noted initially that the stationary part is designated as the left half 1 of the housing and the orbiting structural part as the displacer 3.

The pump essentially comprises, according to FIGS. 1 and 2, of two halves 1, 2 of the housing, connected by suitable means with each other. The displacer 3 is located within them. An annular working chamber 4 is formed in the left half 1 of the housing. The working chamber 4 is divided by a web 5 extending over the entire depth of the chamber. On either side of the web, in the rear wall of the housing half 1, an inlet 6 and an outlet 7 are located for the working medium to be transported. The working chamber is engaged by the annular rib 8 of the displacer 3. The ring is slit at its location opposite the web 5. In operation, the displacer carries out an orbital motion.

During this orbiting motion the displacer is constantly in contact with both the inner and the outer circumferential walls of the working chamber 4. By means of this position dislocation, the working medium is suctioned through the inlet 6 into the chamber 4 and discharged through the outlet 7 from the machine.

An Oldham (cross keyed) coupling is provided for the guidance without rotation of the displacer 3. It consists essentially of an intermediate ring 9 equipped on its two flat sides with lands 10. The lands 10 facing the displacer 3 engage correspondingly shaped vertical grooves 11 in the displacer 3. The lands facing the stationary right half 2, should be located perpendicularly to the first mentioned lands, i.e., horizontally in the present case, for which reason they are not visible in the horizontal section of FIG. 1. They again slide in suitably shaped grooves machined horizontally into the frontal side of the half 2 of the housing.

For the orbital motion of the displacer, according to FIG. 1, a drive by means of a wobble rod 12 is provided. A crank drive 13, not shown in detail, is equipped on the crank side of the rod 12 with an articulation socket, in which the wobble rod 12 is seated rotatingly with a first spherical section 15. However, the invention is not restricted to this particular drive variant. Only a layout in which the wobble rod performs a wobbling and not a rotating motion is preferred, with the axis of motion 30 being located on a conical circumference.

At the end opposite the first spherical section 15, the wobble rod 12 has a second spherical section 16. Coaxially with the principal axis 31 of the crank drive 13, the second spherical section 16 is supported in the stationary part of the housing 1, rotatingly and capable of wobbling.

In the plane of the rotor disk 3, the wobble rod 12 is equipped with a third spherical section 17, the spherical radius of which advantageously corresponds to that of the second spherical section 16. The third spherical section 17 is located rotatingly and wobbling in the hub of the rotor disk 3.

If the support locations for the two spherical sections 16 and 17 are cylindrical bearing bushings, for example, the centrifugal, purely radial forces would be supported on a semicircular line only. Axially directed forces could not be transmitted at all.

Those bearing locations are therefore in the form of hemispherical articulation sockets 18, 19. Because they are hemispherical, the number of individual parts is reduced and the installation is thereof simple.

This, however, is true only if the bearing surface of the spherical socket is within the same hemisphere. This condition leads to the fact that the articulation sockets 18, 19 for the second and third spherical sections are located as mirror images relative to each other, i.e., the bearing spherical surfaces are facing away from each other.

The axial force necessary to hold the spherical sections securely in their sockets under all operating conditions is applied by springs.

Figure 3:
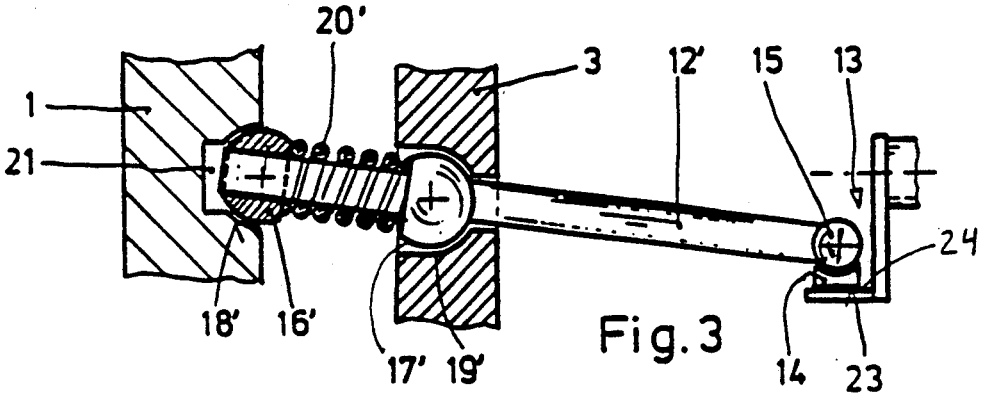
FIG. 3 is a view of a first installation variant of a wobble rod in a longitudinal section.

With reference to FIG. 3, in one embodiment the second spherical section 16' is provided with a center bore and set loosely onto the wobble rod 12', so that the second spherical section 16' may be displaced on the wobble rod. The facing surfaces of the spherical sections 16' and 17' are flattened so as to form a stop for a compression spring 20' In the assembled state the spring 20' pressures the spherical sections apart. To receive the end of the wobble rod 12' when the spherical section 16' is displaced along the rod 12', the articulation socket 18' in the left half 1 of the housing is provided with a recess 21.

Figure 4:
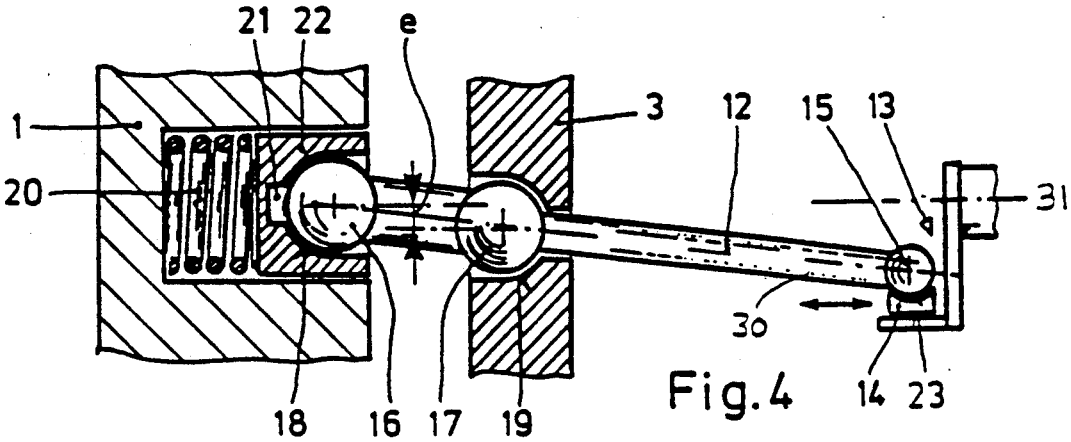
FIG. 4 is a view of a second variant of the installation of the wobble rod in longitudinal section.

With reference to FIG. 4, in another embodiment a sliding block 22 is seated in an axially displaceable manner in the left housing part 1. In the frontal face of the sliding block 22 facing the rotor disk 3, an articulation socket 18 is formed. The spherical section 16 is located in the socket 18. To provide a defined spherical support at all times for the spherical section 16, the bottom of the socket 18 is provided with a recess 21, so that the top end of the spherical section 16 is never in contact with the bottom of the socket 18. The axial force is applied here by a helical spring 20, which is mounted between the housing part 1 and the sliding block 22.

Relative to the layout of FIG. 1, it should be mentioned that the spring force should be high enough so that the displacer 8 may be lifted from the lateral wall of the housing 1. The counter force maintaining the sealing effect is transmitted by the Oldham coupling 9, 10 to the rotor disk 3 of the displacer.

In any case, the spring force should be high enough so that the additional axial force in cooperation with the aforementioned radial force will support the spherical sections in a spherical surface. This spherical contact zone must be maintained in any case, independently of any material wear on any of the machine part involved.

The following examples indicate possible defects that may be compensated by the invention:

In the course of the wobble motion, material may be removed from the ball. In this manner, the ball may score the socket. The diameters of the sphere and the socket are thereby reduced. In view of the constant spherical ball support the connection may be axially identical and free of clearances, although in addition to the reduction of the surface, the distance between the ball centers of the spherical sections 16 and 17 has increased. This condition is valid also, if only the balls or the sockets are abraded.

During the orbital motion the frontal sides of the displacer 8 may wear as a result of contact against the stationary housing 1. According to FIG. 1, this would reduce the distance between the spherical sections 16 and 17. This behavior is again rendered harmless without difficulty by the principles according to FIGS. 3 and 4. In case of a change in the distance between the second and third spherical sections the angle on the conical circumference of the motion axis 30 also changes. This is also true for the distance between the spherical sections 16 and respectively 17 and 15. In each case, the eccentricity e (FIG. 4) on the displacer should be maintained. On the other hand, the plane of the third spherical section 17 determines the translation circle and is thus the reference plane. For this reason, the first spherical section 15 should also be displaceable. It should be displaceable firstly in the longitudinal direction of the wobble rod 12 as indicated in FIG. 4. Secondly, it should also be displaceable in the direction perpendicular to the plane of the drawing, in view of the aforementioned possible change in the angle. Preferably therefore, this first spherical section 15 is again embedded into a bearing bushing equipped with an articulation socket 14. The articulation socket 14 indicated in FIGS. 3 and 4, is in turn provided with a sliding surface 23, which is displaceable in all directions on a corresponding counter surface 24 of the crank drive 13, the sliding surface 23 and the counter surface are both located in a plane parallel to the axis 31 of the crank drive 13.

The advantage of a wobble drive of this type may be stated by the following consideration: the highest radial force present in operation acts on the bearing combination 17/19. That radial force is absorbed by the two bearing combinations 15/14 and 16/18. The choice of lever arms between the spherical sections provides the means to keep the bearing load in the 15/14 combination as low as possible. Consequently, the dimensions of this bearing, in particular its ball diameter, may be small, with the result that the friction force will be low. On the other hand, the articulation sockets for the second and third spherical sections 16, 17 are not separate individual parts, but they are integrated into existing structural parts, on the one hand into the displacer, and on the other, into the stationary housing part or the sliding block. The solution is highly cost effective for this reason alone. As these articulation sockets are merely half shells without undercuts, the molding or pressing tools required for their manufacture are not expensive.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A wobble drive for a structural part moving in translation and being maintained relative to a stationary structural part in a predetermined angular relationship, said stationary structural part having a bearing bush and said translationally moving structural part having a hub, said wobble drive comprising:

a wobble rod;

a crank drive mechanism for driving said wobble rod, said crank drive mechanism having an axis and a bearing bush;

said wobble rod having a first spherical section mounted in the bearing bush of the crank drive mechanism;

said wobble rod having a second spherical section mounted coaxially relative to the crank drive mechanism in an articulation socket of the bearing bush of the stationary structural part;

said wobble rod having a third spherical section located between opposite ends thereof, said third spherical section being supported rotatingly and pivotingly in an articulation socket of a bearing bush in the hub of the translationally moving structural part;

said bearing bushes for the second and third spherical sections being hemispherical articulation sockets located in the manner of a mirror image in the two structural parts;

spring means for ensuring full contact of the second and third spherical section in their respective articulation sockets.

2. The wobble drive mechanism according to claim 1, wherein the second spherical section is set loosely on the wobble rod, and that the spring means is located between the second and the third spherical sections.

3. The wobble drive mechanism according to claim 1, further comprising a sliding block mounted in the stationary structural part, wherein the articulation socket provided for the second spherical section is formed in the sliding block, said sliding block being displaceable under a load produced by the spring means.

4. The wobble drive mechanism according to claim 1, wherein the bearing bush for receiving the first spherical section is in the form of an articulation socket displaceable in a plane parallel to the axis of the crank drive mechanism.

* * * * *